US005692621A

United States Patent [19]

Davis et al.

[11] Patent Number: 5,692,621

[45] **Date of Patent: *Dec. 2, 1997**

[54] SORTING APPARATUS

[75] Inventors: Robert Davis, Charlton; Herbert Fraenkel; Kenneth Henderson, both of London, all of England

[73] Assignee: Sortex Limited, London, England

[ * ] Notice: The term of this patent shall not extend beyond the expiration date of Pat. No. 5,538,142.

[21] Appl. No.: 660,606

[22] Filed: Jun. 6, 1996

Related U.S. Application Data

[63] Continuation of Ser. No. 333,498, Nov. 2, 1994, Pat. No. 5,538,142.

[51] Int. Cl.[6] ..... B07C 5/00

[52] U.S. Cl. ..... 209/555; 209/580; 209/587; 209/938; 250/226; 356/407

[58] Field of Search ..... 209/552, 559, 209/580, 581, 576, 577, 585, 587, 638, 639, 644, 938, 939, 555; 250/222.2, 226, 561; 356/338, 343, 407

[56] References Cited

U.S. PATENT DOCUMENTS

| | | | |
|---|---|---|---|
| 4,203,522 | 5/1980 | Fraenkel et al. | 209/577 X |
| 4,600,105 | 7/1986 | Van Zyl et al. | 209/587 |
| 5,135,114 | 8/1992 | Satake et al. | 209/587 X |
| 5,158,181 | 10/1992 | Bailey | 209/587 X |
| 5,201,576 | 4/1993 | Squyres | 356/394 X |
| 5,303,037 | 4/1994 | Taranowski | 356/406 |
| 5,352,888 | 10/1994 | Childress | 250/223 R |
| 5,538,142 | 7/1996 | Davis et al. | 209/580 |

FOREIGN PATENT DOCUMENTS

| | | | |
|---|---|---|---|
| 223446 | 5/1987 | European Pat. Off. | 209/580 |
| 279041 | 8/1988 | European Pat. Off. . | |
| 396290 | 11/1990 | European Pat. Off. . | |
| 402543 | 12/1990 | European Pat. Off. . | |
| 443769 | 8/1991 | European Pat. Off. . | |
| 4331772 | 3/1995 | Germany . | |
| 6063514 | 3/1994 | Japan . | |

*Primary Examiner*—Tuan Nguyen

*Attorney, Agent, or Firm*—Majestic, Parsons, Siebert & Hsue

[57] ABSTRACT

Sorting apparatus has a conveyor belt or equivalent mechanism for moving particles at a speed sufficient to generate a stream of particles in air, which particles can be graded such that unacceptable material can be removed. The grading or sorting is conducted by a primary scanning system for analyzing light reflected from particles in the stream in a plurality of wavelength ranges. Ejectors for removing particles from the stream are disposed downstream of the scanning system, and are instructed in response to signals received from the scanning system. An auxiliary scanning system is also included to establish the presence of material in the stream, and in the event that a void is detected in a given region, then the analysis of that region by the primary scanning system and any corresponding activation of the ejectors is inhibited.

22 Claims, 2 Drawing Sheets

SORTING APPARATUS

This is a continuation of application Ser. No. 08/333,498, filed Nov. 2, 1994, now U.S. Pat. No. 5,538,142.

BACKGROUND OF THE INVENTION

This invention relates to sorting apparatus. It is particularly concerned with sorting apparatus which grades particles in a flowing stream according to their color characteristics, and activates an ejection mechanism based on that grading to remove unacceptable particles from the stream.

A particular color sorting apparatus of the above type is available from Sortex Limited of London, England under the designation Sortex 5000. That apparatus uses a bichromatic system for scanning particulate material in free flow through air, which system grades each particle in the stream, and instructs ejectors located downstream to remove from the stream particles not matching the predetermined acceptance criteria.

Various sorting apparatus which grade particulate material according to its ability to reflect light in different wavelength ranges are described in U.S. Pat. Nos. 4,203,522; 4,513,868; and 4,699,273, the disclosures whereof are incorporated herein by reference. In apparatus disclosed in the '522 patent detectors are responsive to light reflected from the particles in different wavelength ranges and generate signals indicative of different qualities of the product. These signals are compared and analyzed, to generate a comparison signal which can activate an ejector to remove the relevant particle from the product stream.

Problems can arise in sorting apparatus of the above general type if some individual particles in the product stream are of different sizes. A larger dark product can in some circumstances reflect more total light than a much smaller light object. These problems can to some extent be met by the use of carefully selected background colors, but this solution usually involves a degree of compromise, even where a line scan system is employed. One of the problems in a line scan system is that spaces between products can appear as for example, dark defects. To obtain a matched background across the whole extent of the line scan the variation in illumination across the corresponding particles would have to be correlated both in color and brightness to the background. Even if this were attainable, it would be difficult to maintain in operation. A further degree of enhancement and flexibility in bichromatic sorting may be achieved by creating a say, red/green Cartesian map divided into accept and reject portions. Any background would limit and complicate the full implication of such a method of operation. Thus, the best solution is to eliminate the background from the color measurement.

SUMMARY OF THE INVENTION

According to this invention, a primary scanning system in sorting apparatus is supplemented by an auxiliary scanning system which is used to establish the presence of particulate product in the stream being sorted. If the auxiliary system indicates the absence of any product particle from an area, then a signal is dispatched to inhibit activation of any ejector mechanism for that area. Normally, such a signal will inhibit the output from the primary scanning system itself for that area. By effectively excluding from the scanning mechanism areas of the product stream cross-section which are not occupied, the primary scanning system can be programmed more specifically, and without risk of a sorting error as a result of falsely identifying a background as reject product. The primary scanning system can be mono or multichromatic, but is most usually bichromatic.

A particular apparatus according to the invention comprises means for moving a stream of particles along a predetermined path; a primary, normally bichromatic, scanning system for analyzing light reflected from particles on the moving path in a plurality of wavelength ranges; ejectors disposed downstream of the scanning system for removing particles from the particle stream; and means for activating the ejectors in response to signals from the scanning system, to remove unacceptable particles from the product stream. The primary scanning system is supplemented by an auxiliary scanning system disposed to receive light transmitted across the product stream from a background adapted to emit light in a further, different wavelength range, and this auxiliary system is coupled to the primary system to inhibit activation of the ejectors, or indeed operation of the primary scanning system in an area or areas of the product stream through which such light has been transmitted directly from the background to the auxiliary system. By this mechanism it will be understood that the primary scanning system can be operated on the basis that all the light it analyses is light reflected from material in the product stream.

In order of course to ensure that the signals generated by the auxiliary scanning system are accurate, it is important to ensure an adequate intensity of the background lighting. To this end, it is preferred in apparatus according to the invention to create the background in the form of a light beam reflected from the surface of a rotating cylinder which can be under continuous cleaning.

Apparatus according to the invention will normally include a bichromatic scanning system adapted to analyze reflected light in the visible wavelength ranges, typically "red" and "green." The background to the auxiliary system is also preferably generated using light in a different visible wavelength range, and thus "blue" could be used in this case. The bichromatic scanning system can then comprise a visible light camera with an infra-red blocking filter between it and the product stream. This is usual practice to eliminate infra-red to which the three color array are also sensitive in for example, the KODAK KL12103. The "red", "green", and "blue" detectors in the Kodak array are located such that the viewed light from the locations in the product stream are spaced from each other in the direction of movement. A computer or microprocessor will usually be included in the apparatus to store and compensate for the sequential timing of the outputs of the rows of color sensitive pixels in the scanning systems, and make appropriate adjustments in the processing before instructing the ejectors.

It is also possible to include an additional infra-red scanning assembly in combination with the primary and auxiliary scanning systems already described. This can use a similar system to that described with reference to the visible light emissions, preferably also using a visible light blocking filter instead of the infra-red blocking filter employed there. In the infra-red scanning array the normally built in color filters can be omitted. AS noted above, light of different wavelength ranges can be mixed to create the background, and light in the infra-red range can easily be included. This infra-red scanning assembly would be used as a "dark" or "light" sort, broadly in the same way as it is described in U.S. Pat. No. 4,203,522 referred to above. Alternatively, the sensor in the infra-red scanning system can be made responsive to the for example, "blue" background so that the infra-red illumination on the background would not be required in a "dark" only sort.

The invention will now be described by way of example and with reference to the accompanying schematic drawings.

DESCRIPTION OF THE PREFERRED EMBODIMENTS

Figure 1:
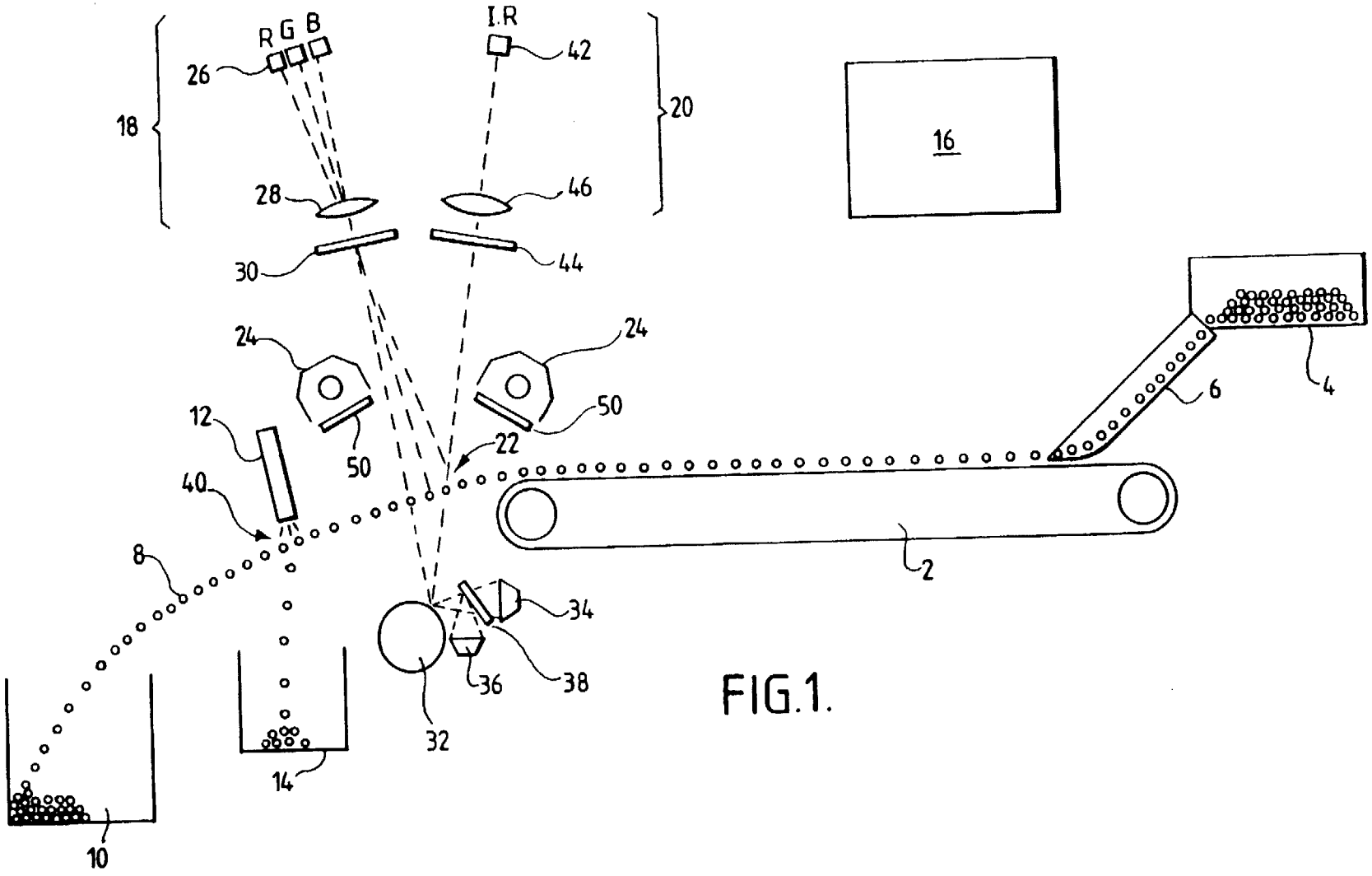
FIG. 1 illustrates diagrammatically the operation of apparatus according to the invention.

FIG. 1 illustrates a conveyor 2 to which particulate material is fed from a hopper 4 down a chute 6. The conveyor belt is driven such that its upper level moves from right to left as shown at a speed (for example, 3 meters per second) sufficient to project material in a product stream 8 to a receptacle 10. During its passage from the end of the conveyor 2 to the receptacle 10, the material is kept in the product stream 8 solely by its own momentum. Ejectors 12 extend over the width of the product stream 8, and are operable to remove particles from specific zones of the product stream 8 by high pressure air jets, directed towards the reject receptacle 14. Typically, the lateral width of the product stream is 20 inches, with forty ejector nozzles equally spaced thereover. The ejectors 12 are instructed by a computer or microprocessor 16, which itself receives input data from the scanning systems 18 and 20 described below.

Reference numeral 22 indicates a region in the product stream 8 where the product is scanned. Region 22 is illuminated by a light source 24, with a blue light blocking filter 50, and particles in the region 22 reflect light which is received in the scanning assembly 18. The assembly 18 comprises essentially a visible light camera 26, lens 28, and infra-red light blocking filter 30. The camera 26 comprises charge coupled devices which monitor light received in specified visible light wavelength ranges, in this case three, "red", "green", and "blue" (R, G, B). The charge coupled devices in the camera 26 are arranged in rows each extending the entire lateral dimension of the product stream.

As shown, particles at the entrance to the scanning zone are first scanned for reflected light in the "red" wavelength range. It is then examined for reflected light in the "green" wavelength range, before finally being examined for light in the "blue" range. For most sorting processes for which apparatus according to the present invention is used, a product can be satisfactorily graded on the basis of reflected light in the "red", and "green" wavelength ranges. The "blue" detector array is therefore not used as part of the grading process, but to determine whether that area in the product stream is occupied at all. The "blue" detector array is aligned with a cylinder 32 on the other side of the product stream 8, which is itself illuminated by blue light source 34 and infra-red light source 36 using a dichroic or partially silvered mirror 38 as indicated. The purpose of the infra-red lamp will be described below. The background illumination could alternatively or additionally be provided by suitably colored, possibly flashing LED's.

The "red" and "green" light detectors generate signals which are passed to the computer 16 which conducts a bichromatic sort analysis of particles in the product stream as is known in apparatus of this type. If the analysis indicates that a particle is defective, then the computer 16 instructs the battery of ejectors 12 to remove that particle from the stream by the delivery of an air pulse to the appropriate section of the stream in the removal zone 40. Such removed particles are deflected from the path of the product stream into the reject receptacle 14.

So long as the product stream is filled with particles, then the "blue" detector will remain inactive. However, when spaces appear, the blue light from the source 34 reflected by the cylinder 32 will be recognized by the "blue" detector as indicating the absence of any product material in the particular areas. In response to this event, the blue detector generates a signal which is transmitted to the computer 16, and upon receipt of which the computer inhibits its bichromatic analysis of that particular area and also any activation of the ejectors therefor.

Because of the sequential involvement of the red, green and blue detectors, and the downstream disposition of the removal zone 40 relative to the scanning zone 22, the signals therefrom are stored in memories in the computer 16 prior to analysis. This also enables analysis of the signal from the blue detector and of course, means that the signals from the red and green detectors can be ignored or discarded if analysis of a signal from the blue detector indicates the absence of any particle from the product stream in a given area. Thus, the reception of an "inhibit" signal from the blue detector effectively prevents analysis of the signals from the red and green detectors.

As noted above, the rotating surface of the cylinder 32 is also illuminated with light in the infra-red wavelength range, and an additional detector 42 in the form of a single line array of charge coupled devices is included to watch for such reflected light. The detector 42 receives light from the cylinder 32 along a path through the product stream 8 at the upstream end of the scanning zone, a visible light blocking filter 44 and a focusing lens 46. This scanning system enables an additional dark and/or light sort to be obtained, depending upon the brightness of the infra-red light source 36 which can also of course be conducted quite independently of the inhibiting activity of the blue detector in the camera 26. Thus, signals generated by the detector 42 will again be transmitted to the computer 16, but analyzed quite separately to instruct the ejectors 12 as appropriate.

Figure 2:
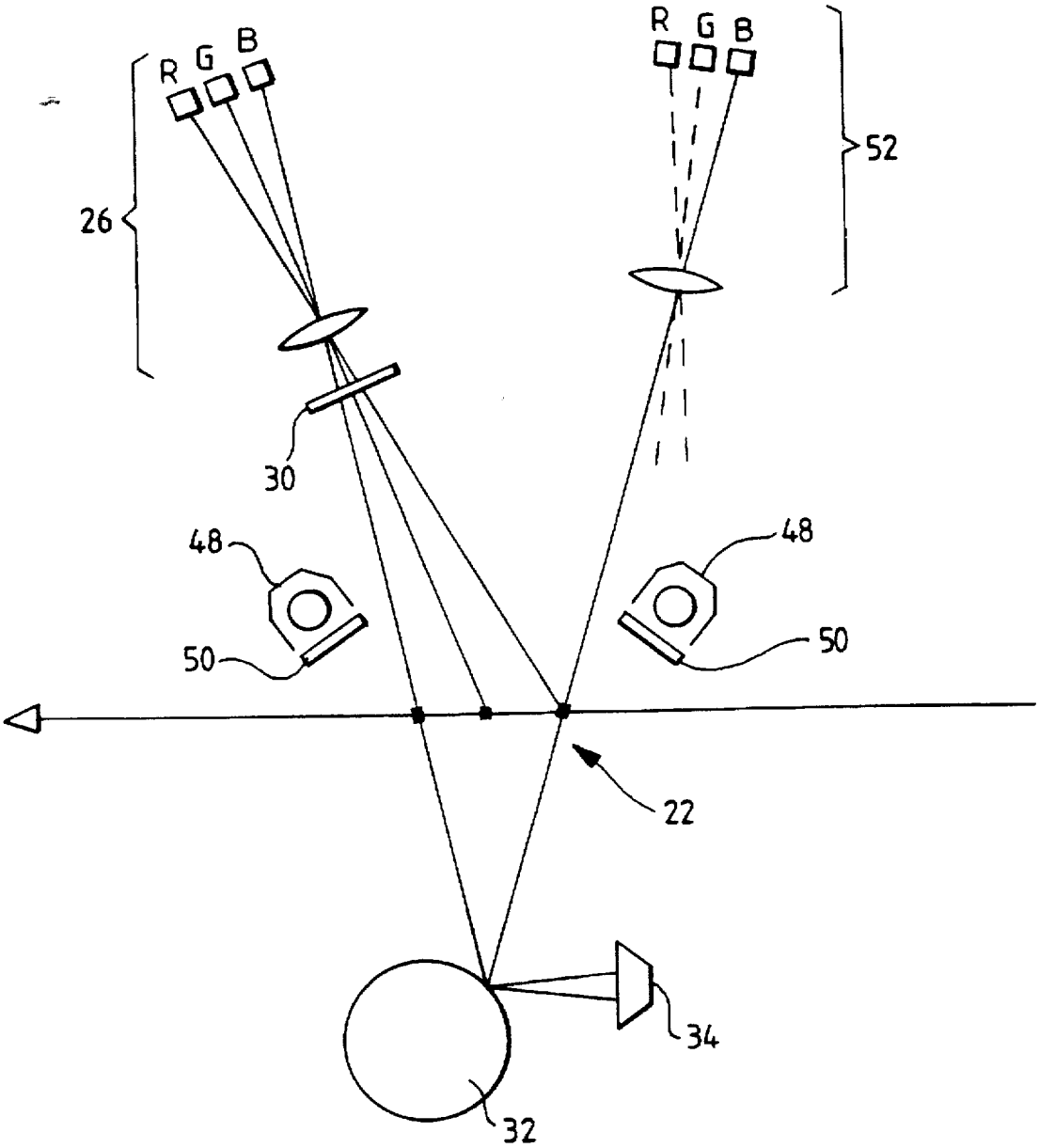
FIG. 2 shows a modification of the apparatus of FIG. 1.

In the modification shown in FIG. 2, the visible light camera 26 operates in the same way as does the camera 26 in FIG. 1, to receive reflected light from particles in the product stream 8 in the scanning region 22. The region 22 is illuminated by light sources 48 which have blue light blocking filters 50, and any blue light transmitted across the product stream 8 from roller 32 is received and monitored by the "blue" detectors in camera 26. However, the sources 48 also emit light in the infrared wavelength range, and an infra-red camera 52 is used to monitor reflected light in the blue and infra-red ranges. The camera 52 is of the same type as the camera 26, but uses only the blue detector array which responds in the "blue" range (400 to 500 nm) and in the infra-red range (700 to 1000 nm). Thus the camera 52 will generate a "light" output when viewing either bright infra-red reflected from particles in the product stream 8 or the blue background, and correspondingly the camera 52 will give a dark output when viewing an infra-red absorbing particle. Signals generated by the camera 52 are also processed by the computer 16 to activate the appropriate ejector when a product particle comes into view which is darker in IR relative to the "blue" background than a set limit. This enables an IR "dark" sort to be conducted simultaneously with the bichromatic sort conducted using the camera 26.

The embodiments of the invention described above are given by way of example only, and illustrates one of many ways the invention may be put into effect. Variations can be made, and alternative equipment can be used, without departing from the spirit and scope of the invention claimed herein.

We claim:

1. Sorting apparatus comprising means for moving a stream of particles along a predetermined path; a primary scanning system for analyzing light reflected from particles on said path in a plurality of wavelength ranges; ejecting means disposed downstream of the scanning system for ejecting particles from said path; and means for activating the ejecting means in response to signals from the scanning system, whereby unacceptable particles are ejected from said system, the apparatus including an auxiliary light source for creating a background emitting light in a further wavelength range and an auxiliary scanning system disposed to receive light transmitted across said path from said background for emitting light in a further wavelength range, and means coupled to the auxiliary system to inhibit analysis of light in the primary scanning system activation of the ejecting means in an area of the path through which light in said further wavelength range has been transmitted directly from the background to the auxiliary system, thereby indicating the absence therefrom of any particle to be sorted.

2. Apparatus according to claim 1 including a light source and a reflector for creating the background to the auxiliary scanning system.

3. Apparatus according to claim 2 wherein the reflector is on the surface of a rotating cylinder.

4. Apparatus according to claim 1 wherein the primary scanning system is a multichromatic system.

5. Apparatus according to claim 4 wherein the multichromatic scanning system is a bichromatic system for analyzing reflected light in two of three wavelength ranges consisting of "red", "green" and "blue" wavelength ranges, and wherein the background created by the auxiliary light source emits light in the third of said three wavelength ranges.

6. Apparatus according to claim 5 wherein the bichromatic and auxiliary scanning systems comprise a single camera unit with a lens and an infra-red blocking filter between the particle path and the camera, the camera being located relative to the path such that it receives light from sequential locations in the path.

7. Apparatus according to claim 1 including a computer for storing and analyzing information received from the scanning systems and instructing the ejecting means pursuant to such analysis.

8. Apparatus according to claim 1 wherein the coupling means inhibits operation of the multichromatic scanning system in response to the auxiliary system indicating the absence of a particle to be sorted from a said area.

9. Apparatus according to claim 1 wherein the primary and auxiliary scanning system operate in response to light in visible wavelength ranges, and including a further scanning system for receiving light transmitted across said path from a background emitting light in the infra-red.

10. Apparatus according to claim 9 wherein the auxiliary and further scanning systems are situated to receive light from the same background.

11. Apparatus according to claim 10 wherein the background is the surface of a rotatable cylinder illuminated by lamps emitting light respectively in the infra-red wavelength and said further wavelength ranges.

12. Apparatus according to claim 1 including a further scanning system for receiving light in said further wavelength ranges transmitted across said path and in an additional wavelength range reflected from particles in said path, the further scanning system activating the ejecting means in response to a comparison between light sensed in said additional wavelength range and that sensed in said further wavelength range.

13. Apparatus according to claim 12 wherein the transmitted range is in the visible range and the reflected light is in the infra-red, activation of the ejecting means being in response to light received being darker in infra-red relative to the transmitted light.

14. A method of sorting particles moving in a stream along a predetermined path comprising:

analyzing in a primary scanning system light reflected from particles in said stream in a plurality of wavelength ranges to identify acceptable and unacceptable particles;

monitoring in an auxiliary scanning system the receipt of light transmitted across said path from a background that operates to emit light in a further wavelength range to identify the absence from said path of a particle to be sorted;

activating an ejector to eject from said stream particles identified as unacceptable by the primary scanning means; and inhibiting analysis in the primary scanning system of light received from a particular area of said path and thereby activation of the ejector in response to a signal from the auxiliary scanning system indicating the absence of a particle from said particular area of said path.

15. A sorting apparatus comprising:

means for moving a stream of particles along a predetermined path;

a primary scanning system for detecting light reflected from a particle within a viewing area on said path in a plurality of wavelength ranges, said reflected light deriving its light from a primary light source;

a secondary scanning system that detects light transmitted across said viewing area in a further wavelength range for determining the presence of a particle in said viewing area, said transmitted light deriving its light from a secondary light source, wherein said secondary scanning system is independent of said primary scanning system;

analyzing means coupled to said primary and secondary scanning systems for analyzing light detected from said primary scanning system to identify acceptable and unacceptable particles and for producing an activating signal conditioned upon an identification of an unacceptable particle, wherein said secondary scanning system inhibits said analyzing means when there is an absence of particles in the viewing area; and ejecting means disposed downstream from said primary scanning system for ejecting said unacceptable particle from said path in response to said activating signal.

16. An apparatus as defined in claim 15 wherein the secondary scanning system further includes a reflector.

17. An apparatus as defined in claim 16 wherein the reflector is on the surface of a rotating cylinder.

18. A method of sorting particles moving in a stream along a predetermined path comprising:

a) analyzing in a primary scanning system light reflected from particles in said stream in a plurality of wavelength ranges to identify acceptable and unacceptable particles;

b) monitoring in an auxiliary scanning system the receipt of light transmitted across said path from a background that operates to emit light in a further wavelength range to identify the absence from said path of a particle to be sorted, wherein said auxiliary scanning system is independent of said primary scanning system;

c) activating an ejector to eject from said stream particles identified as unacceptable by the primary scanning means; and d) inhibiting the performance of step a in response to a signal from the auxiliary scanning system indicating the absence of a particle from a particular area of said path.

19. Sorting apparatus comprising:

means for moving particulate material in a product stream along a predetermined path in which the material is retained in the stream solely by its own momentum;

a primary scanning system for analysing light reflected from particles on said path in a plurality of wavelength ranges;

ejecting means disposed downstream of the scanning system for ejecting particles from said path; and means for activating the ejecting means in response to signals from the scanning system, whereby unacceptable particles are ejected from said system;

an auxiliary light source for creating a background emitting light in a further wavelength range;

an auxiliary scanning system disposed to receive light transmitted across said path from said background for emitting light in a further wavelength range; and means coupled to the auxiliary system to inhibit analysis of light in the primary scanning system activation of the ejecting means in an area of the path through which light in said further wavelength range has been transmitted directly from the background to the auxiliary system, thereby indicating the absence therefrom of any particle to be sorted.

20. Apparatus according to claim 19 wherein the moving means comprises a conveyor having a conveyor belt and means for driving the belt to project said particulate material from the end of the conveyor in said product stream.

21. Apparatus according to claim 20 including a hopper and a chute for delivering said particulate material from the hopper to the conveyor belt.

22. A method of sorting particulate material moving in a product stream along a predetermined path, the method comprising:

retaining the material in said product stream by its own momentum;

analysing in a primary scanning system light reflected from particles in said stream in a plurality of wavelength ranges to identify acceptable and unacceptable particles;

monitoring in an auxiliary scanning system the receipt of light transmitted across said path from a background that operates to emit light in a further wavelength range to identify the absence from said path of a particle to be sorted;

activating an ejector to eject from said stream particles identified as unacceptable by the primary scanning means; and inhibiting analysis in the primary scanning system of light received from a particular area of said path and thereby activation of the ejector in response to a signal from the auxiliary scanning system indicating the absence of a particle from said particular area of said path.

* * * * *